United States Patent [19]

Coyle

[11] 4,310,109

[45] Jan. 12, 1982

[54] PENCIL HOLDER

[76] Inventor: Francis S. Coyle, 185 Plateau Ave., Pocatello, Id. 83201

[21] Appl. No.: 230,613

[22] Filed: Feb. 2, 1981

[51] Int. Cl.[3] ..... A45C 11/04; B43K 25/00

[52] U.S. Cl. ..... 224/230; 224/231; 24/10 R; 206/371; 206/37

[58] Field of Search ..... 224/230, 231, 235, 242, 224/245, 194; 206/37; 24/10 R, 11 HC

[56] References Cited

U.S. PATENT DOCUMENTS

| | | | |
|---|---|---|---|
| 1,092,244 | 4/1914 | Coolidge | 24/10 R |
| 2,020,979 | 11/1935 | Wiedermann | 24/10 R |
| 2,567,602 | 9/1951 | Higgins | 224/231 |
| 3,371,829 | 3/1968 | Phillips | 224/230 |
| 3,741,376 | 6/1973 | Brown et al. | 224/230 X |

FOREIGN PATENT DOCUMENTS

| | | | |
|---|---|---|---|
| 42089 | 11/1925 | Norway | 224/230 |

*Primary Examiner*—Steven M. Pollard

*Attorney, Agent, or Firm*—Gregg I. Anderson

[57] ABSTRACT

A pencil holder having a main body which is adapted to fit within a shirt pocket is disclosed. A multi-biased spring releasably fastens the pencil holder to the shirt pocket and simultaneously retains pens or pencils placed within the pencil holder.

8 Claims, 6 Drawing Figures

PENCIL HOLDER

BACKGROUND OF THE INVENTION

1. Field of Invention

The present invention relates generally to article holders. More particularly, the present invention relates to container-type holders for pencils and pens.

2. Description of the Prior Art

Pencil or pen containers that fit within the pocket of a shirt are known. In such a pencil container, the pocket of the shirt acts as a sheath for the main body of the container, which body includes a back panel extending the full depth of the pocket, an integral guard extending above the shirt pocket and a front panel integrally connected to the back panel extending substantially the depth of the pocket. An opening for the insertion of pencils is formed between the front and back panels. A pocket panel extends integrally from the top of the front panel over the shirt pocket and downwardly to lie adjacent to the exterior of the shirt pocket.

The prior art pencil containers work adequately for protecting a shirt pocket from being marked by pens and pencils inserted therein. However, even with a pen or pencil having a clip capable of fastening over the shirt pocket, if the user of the pencil holder bends over into a position below horizontal, the entire pencil container and/or pens or pencils contained therein can fall out of the shirt pocket. Even should the user of the pencil container remain relatively upright, frequent exertion and movement can easily dislodge individual pencils and even the entire pencil container from the shirt pocket.

SUMMARY AND OBJECTS OF THE INVENTION

The principal object of the present invention is to provide a pencil holder that fits into a shirt pocket to releasably fasten to the shirt pocket.

A related object of the present invention is to provide a pencil holder that positively retains pencils therein.

In accordance with the objects of the invention, a pencil holder includes a back panel extending the depth of a shirt pocket and a guard coplanar therewith extending a relatively short distance above the shirt pocket. A front panel is connected adjacent to the back panel along three sides, leaving the top of the front panel unconnected to form an opening with the back panel for receipt of pens or pencils. An integral double walled pocket panel, having a second top opening between the double wall construction extends from the front panel and over the top of the shirt pocket and down the exterior of the shirt pocket for a relatively short distance.

A single continuous wire is used to construct a multi-biased spring which acts to bias the pocket panel against the front panel and simultaneously pulls the back panel toward the front panel. A generally rectangular frame of the double biased spring is received within the second opening in the pocket panel. A pair of coil springs are biased toward the frame by a pair of spring arms, a spring arm and coil spring formed from separate ends of the wire. One of the spring arms therefore integrally connects the frame to one of the coil springs. The coil springs of the multi-biased spring are constructed from alternating loops, which loops are formed from the separate ends of the wire, one loop being turned clockwise, relative to the frame, the next loop counterclockwise. The ends of the wire are twisted together into a tie and clamped by a connection plate or badge lying adjacent to and exterior to the back panel.

DESCRIPTION OF THE PREFERRED EMBODIMENT

Figure 1:
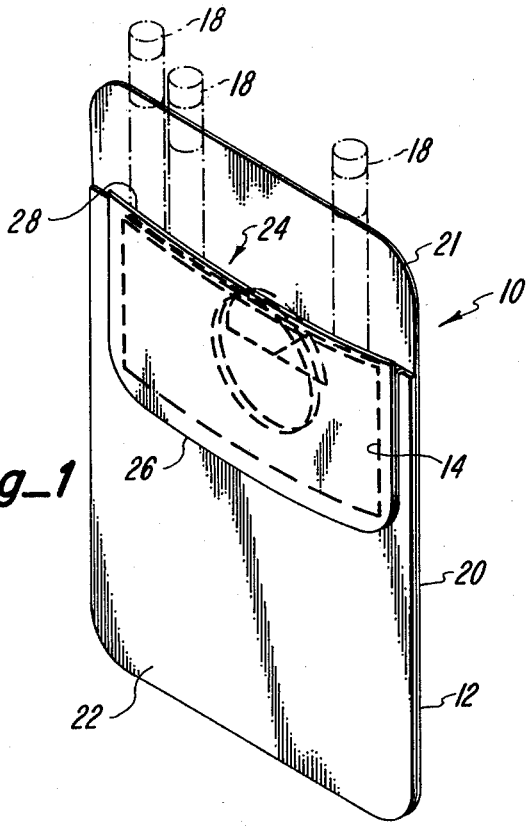
FIG. 1 is a perspective view of the pencil holder of the present invention with retained pencils and the multi-biased spring shown in dotted line.

A pencil holder 10 is embodied in a main body portion 12 of essentially conventional construction and a multi-biased spring 14 operatively interconnecting specific portions of the main body 12 is seen in FIG. 1. The main body 12 is preferably formed of vinyl or a relatively high density polymeric plastic film. The multi-biased spring 14 and main body are adapted to releasably attach to a shirt pocket 16 (FIG. 5) and retain or hold a plurality of pens or pencils 18 therein.

The main body 12 includes a generally rectangular flat back panel 20 (FIGS. 5 and 6) which substantially fills the interior of the shirt pocket 16. An integral guard 21 extends a relatively short distance above the shirt pocket 16 from the back panel 20. A generally flat rectangular front panel 22 is joined to or formed with the back panel 20. The front panel 22 is integrally connected to the back panel along three sides thereof, leaving an opening 24 that is associated with the opening in the shirt pocket 16 when the body 12 is inserted into the shirt pocket.

A pocket panel or flap 26 (FIGS. 1 and 5) is integrally connected to the front panel 22 along the unconnected or free edge of the front panel 22, which edge helps define the opening 24. The pocket panel 26 extends over and descends downwardly along the front or outside of the shirt pocket 16. The pocket panel is of double wall construction, integrally interconnected along three sides, so as to form an opening 28 in the pocket panel adjacent to first opening 24 but outside of the pocket 16.

The main body 12 of the pencil holder 10 as above described, is of conventional nature. The main body portion 12 is commercially available from many sources, and often depicts advertising on the pocket panel 26.

Figure 3:
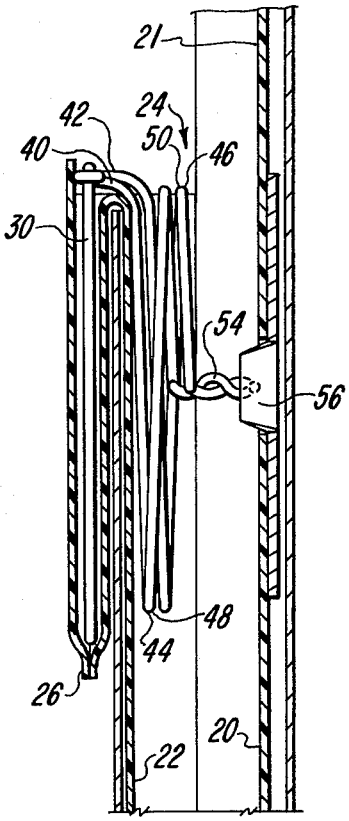
FIG. 3 is a front elevational view of the multi-biased spring utilized with the pencil holder shown in FIG. 1.
Figure 3:
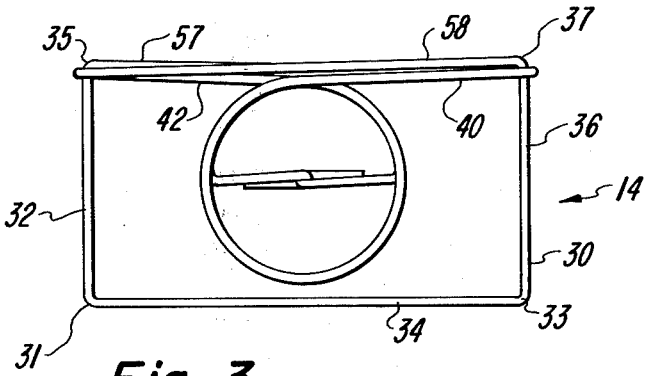
Figure 4:
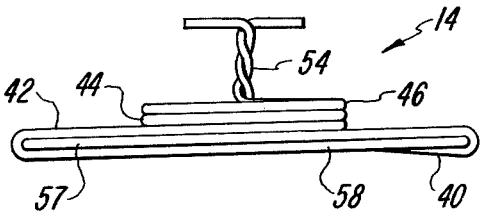
FIG. 4 is a top plan view of the multi-biased spring of the pencil holder shown in FIG. 1.
Figure 2:
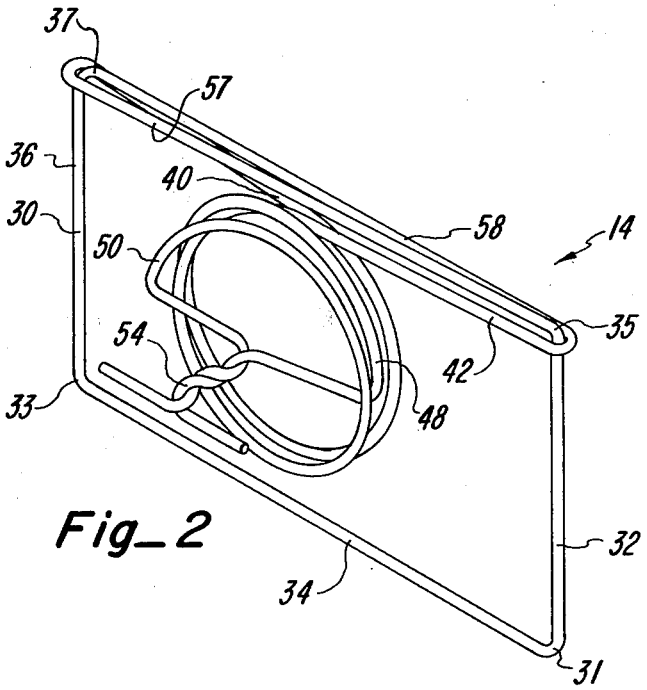
FIG. 2 is a perspective view of the multi-biased spring utilized with the pencil holder shown in FIG. 1.

The multi-biased spring 14, when utilized in conjunction with the main body 12, results in a pencil holder 10 that is releasably but positively affixed to the shirt pocket 16 and also positively retains any pencils 18 inserted in the opening 24. As seen in FIGS. 2 through 4, the multi-biased spring 14 includes a generally rectangular frame 30 adapted to be inserted into the second opening 28 in the pocket flap 26. The frame 30, and the entire multi-biased spring 14, are constructed from a continuous piece or length of spring wire.

The frame 30 is formed by making a first right angle bend 31 in the wire and a second right angle bend 33, defining therebetween a bottom member 34 along the length of wire between the first two bends. A third right angle bend 35 establishes a first side member 32 between the first and third right angle bends 31 and 35. A fourth right angle bend 37 establishes a second side member 36 between the second and fourth right angle bends 33 and 37.

The ends of the wire are, at this step of forming the frame, exterior of the area ultimately circumscribed by the frame 30. The end of wire extending away from the third right angle bend 35 is bent 180° around second side member 36, defining a top member 57 ending near bend 37. From the top member 57, the free end of the wire turns back into the area of the center of the frame 30, defining a first spring arm 40. The end resulting from the fourth right angle bend 37 is bent 180° around first side member 32 defining a second top member 58, ending near bend 35. From top member 58 the other free end of the wire turns back into the area of the center of the frame 30 defining a second spring arm 42. During this process, the spring arms 40 and 42 are biased so that as frame 30 is positioned in the opening 28 of the pocket panel 26, the spring arms tend to force the front panel 22 toward the pocket panel 20. It is this last described structure of the multi-biased spring 14 that releasably fastens the pencil holder 10 to the shirt pocket 16.

Figure 5:
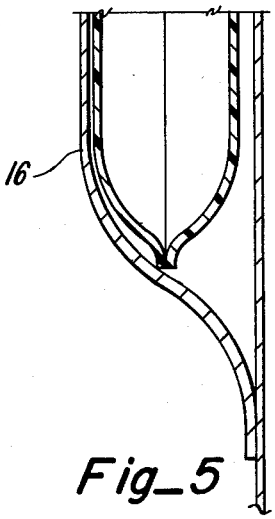
FIG. 5 is a fragmentary enlarged sectional side elevation view of the pencil holder shown in FIG. 1 inserted in a shirt pocket.
Figure 6:
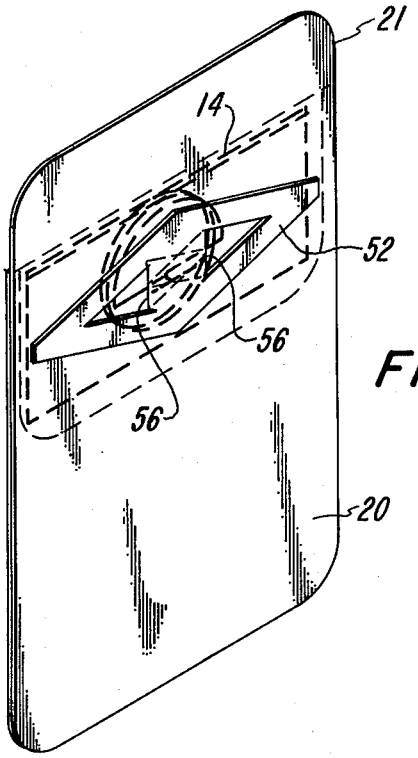
FIG. 6 is a perspective view of the opposite side of the pencil holder shown in FIG. 1 with the multi-biased spring shown in dotted line.

In order that the pencil holder 10 retain pencils 18 between the back panel 20 and front panel 22, spring arms 40 and 42 are each integrally connected, through the continuous spring wire, to a pair of coil springs 44 and 46 respectively (FIGS. 2 and 4). The spring arms pass over the top of the shirt pocket 16 and front panel 22, into opening 24. The coil springs 44 and 46 fit into the opening 24 between the back panel 20 and front panel 22. The coil springs each consist of one and one quarter loops in the continuous wire, each loop having a center point approximately coincident with the center point of the rectangular frame 30. A first loop 48 of coil spring 44 is biased against the front panel 22 on the side of the front panel adjacent to the back panel 20 by the first spring arm 40, to which the first loop 48 is integrally connected. The bias action of the first spring arm 40 forces the first loop 48 toward the frame 30, which completely circumscribes the coil springs and clamps the pencil holder 10 over the shirt pocket 16. In a like manner the second spring arm 42 biases a second loop 50 integrally connected to the spring arm 42 of coil spring 46, against the first loop 48 of the coil spring 44. The second loop 50 is turned in a direction opposite that of the first loop. The loops 48 and 50 of coil springs 44 and 46 are therefore stacked against each other adjacent to the inside of the front panel 22 (FIG. 5). The coil springs 44 and 46 therefore take up very little space between the front panel 22 and back panel 20 so that pencils 18 can be inserted into the opening 24. The axes of generation of the loops 48 and 50 of the coil springs 44 and 46 are coincident with each other and perpendicular to the plane of the frame 30.

The back panel 20 is pulled or biased toward the front panel 22 by the coil springs 44 and 46 so that the pencils 18 are firmly held within the pencil holder 10 by reason of being pinched between the back panel 20 and the spring arms 40 and 42 of the frame 30. The inside of the pencil holder is preferrably lined with a fabric liner (not shown) that has a nap that assists in holding the pencils 18.

A connection plate 52 is placed on the outside of the back panel 20 (FIG. 6) and is connected to the two ends of the wire, which are twisted or intertwined together to form a tie 54 after the termination of loops 48 and 50 (FIGS. 2 and 4), which tie is adapted to pull the back panel 20 toward the first and second coil springs 44 and 46 and provide space for pencils 18 to be snugly inserted into opening 24. Two triangular tangs 56 are punched out of the connection plate 50 and project through the back panel 20. These tangs are bent over the two wire ends, which are splayed to either side of the tie 54, to positively connect the back panel to the coil springs 44 and 46.

The bias of the coil springs 44 and 46 therefore pulls the back panel 20 toward the front panel 22. Any pencils 18 placed in the opening 24 are therefore secured between the top of the frame 30 and the back panel 20.

The foregoing embodiment of the invention has been described with a certain degree of particularity. It should be understood, however, that this description has been made by way of example and that certain departures therefrom may be possible without departing from the spirit and scope of the invention defined in the appended claims.

What is claimed is:

1. In a pencil containing device of the type adapted to fit inside of a shirt pocket, said pencil containing device having a back panel and connected front panel which have an opening therebetween adapted to receive pencils, said front panel further having an integral pocket panel extending over said shirt pocket and lying adjacent to the outside of said shirt pocket, wherein the improvement comprises:

spring means interconnecting said back panel and said pocket panel for biasing said back panel toward said pocket panel, whereby said pencil holding device releasably fastens to said shirt pocket and positively retains pencils inserted in said opening.

2. The invention defined in claim 1 wherein said spring means further includes:

a first spring means for biasing said front panel toward said pocket panel; and a second spring means for biasing said back panel toward said front panel, said second spring means integrally connected to said first spring means.

3. The invention defined in claim 2 wherein said first spring means further includes:

a generally rectangular frame having a bottom member, a top member and two side members, said frame connected to said pocket panel; and at least one spring arm rigidly connected to one of said side members, said spring arm further being rigidly connected to said second spring means.

4. The invention defined in claim 3 wherein said second spring means includes a coil spring integrally connected to said spring arm, said coil spring formed of at least one loop, a last loop of said coil spring rigidly connected to said back panel by a tie.

5. The invention defined in claim 4 wherein there are two spring arms, one connected to each side member, each of said spring arms further connected to a separate coil spring, the last loop of each coil spring having an end, said ends intertwined to form said tie.

6. The invention defined in claim 2 wherein said first and second spring means are a continuous length of spring wire, said first spring means further including:

a generally rectangular frame rigidly connected to said pocket panel, said frame having a bottom member, two side members formed from opposite ends of said wire, said side members extending perpendicularly in the same direction from said bottom member, a pair of top members, each top member extending generally perpendicularly from one side member to an opposite side member, each of said top members bent at least 180° around said opposite side member; and a pair of spring arms integrally extending from said top members at said opposite side member to approximately the center of said rectangular frame where said spring arms integrally connect to said second spring means.

7. The invention defined in claim 6 wherein said second spring means further includes:

a first coil spring formed from one of said ends of said wire and integrally connected to one of said spring arms, said first coil spring including at least one 360° loop;

a second coil spring formed from another end of said wire and integrally connected to the other spring arm, said second coil spring including at least one 360° loop, said loops of said first and second coil springs being interleved alternately and lying on each other, said loops further having a common axis perpendicular to the plane of said frame, said ends of said first coil spring and said second coil spring being intertwined into a tie adapted to connect to said back panel.

8. The invention defined in claim 7 wherein said connection between said tie and said back panel further includes:

a generally flat plate disposed between the back panel and the shirt, said plate having clasp means adapted to pass through said back panel and connect to the ends of said wire.

* * * * *